US007824275B2

(12) United States Patent
Sussich

(10) Patent No.: US 7,824,275 B2
(45) Date of Patent: Nov. 2, 2010

(54) GOLFING AID

(75) Inventor: Marino Sussich, Little River (AU)

(73) Assignee: Indevcom Pty Ltd. (AU)

( * ) Notice: Subject to any disclaimer, the term of this patent is extended or adjusted under 35 U.S.C. 154(b) by 115 days.

(21) Appl. No.: 11/992,860

(22) PCT Filed: Sep. 4, 2006

(86) PCT No.: PCT/AU2006/001281

§ 371 (c)(1),
(2), (4) Date: Mar. 28, 2008

(87) PCT Pub. No.: WO2007/035980

PCT Pub. Date: Apr. 5, 2007

(65) Prior Publication Data

US 2009/0137332 A1 May 28, 2009

(30) Foreign Application Priority Data

Sep. 30, 2005 (AU) ..... 2005905415

(51) Int. Cl.
*A63B 69/36* (2006.01)

(52) U.S. Cl. ..... 473/219; 473/223; 473/226; 473/241; 473/242; 473/251

(58) Field of Classification Search ..... 473/219–256; 33/273, 334, 343, 379–390
See application file for complete search history.

(56) References Cited

U.S. PATENT DOCUMENTS

| | | | | |
|---|---|---|---|---|
| 2,541,366 | A * | 2/1951 | Kennedy | 33/373 |
| 4,079,520 | A | 3/1978 | Davis | |
| 4,274,208 | A * | 6/1981 | Yakkel | 33/371 |
| 4,394,799 | A * | 7/1983 | Moree et al. | 33/343 |
| 4,934,706 | A | 6/1990 | Marshall | |
| 5,160,142 | A | 11/1992 | Marshall | |
| 5,167,075 | A * | 12/1992 | Weldy et al. | 33/343 |
| 5,421,098 | A * | 6/1995 | Muldoon | 33/508 |
| 5,509,657 | A * | 4/1996 | Guthry | 473/241 |
| D405,145 | S * | 2/1999 | Bac et al. | D21/793 |
| 5,893,804 | A * | 4/1999 | Pan | 473/240 |
| 6,716,109 | B1 | 4/2004 | Murtha | |
| 6,839,973 | B1 | 1/2005 | Woodward | |
| 7,387,576 | B2 * | 6/2008 | Agnew | 473/240 |
| 2004/0176176 | A1 | 9/2004 | Murtha | |
| 2005/0148403 | A1 * | 7/2005 | Fiegener et al. | 473/241 |

* cited by examiner

FOREIGN PATENT DOCUMENTS

| | | |
|---|---|---|
| WO | WO00/66230 | 11/2000 |

*Primary Examiner*—Sebastiano Passaniti
(74) *Attorney, Agent, or Firm*—John F. Letchford; Archer & Greiner, P.C.

(57) ABSTRACT

A golfing aid 11 having two levelling sensors 32, 33 mounted on a D shaped sensor body 31 and a mounting means having three adjustable connectors 41, 51, 61 for adjusting the orientation of the D shaped sensor body 31 and an indication output in the form of spirit level bubbles 32, 33 for providing an indication of the sensed level orientation. A system of interactive adjustable connectors linked together to provide such variability that allows connection to any one of left and right handed clubs with different shaft diameters, different angle of putter shaft to putter head and different length shafts and different length putter heads to allow for substantially aligned overlying of the D shaped sensor body 31 over the putter head 23 while substantially aligning the golfing aid front face 34 correctly with the putter head front face 24.

12 Claims, 10 Drawing Sheets

GOLFING AID

FIELD OF THE INVENTION

This invention relates to an aid for assisting a player in making a good golf swing. It is particularly aimed at an aid for assisting a player in making a good putting action but is not limited to such.

BACKGROUND OF THE INVENTION

The sport of golf represents a major recreational activity for an increasing number of people. Reasons why golf has become increasingly popular globally over the past two decades can be attributed in part to increased/improved television broadcasting of national and international tournaments and corporate investment in endorsements and sponsorship of heavily marketed professional golfers.

As the global population has become increasingly aware of the sport of golf, many people have opted to join golf clubs as a means of improving health, social contact in a recreational environment and even business networking. One advantage that golf has over many other sports is that it can be played by people of all ages, body types and state of fitness.

To become proficient at golf, a player will need to achieve a consistent swing and putting stroke. The mechanics of a golf swing(s) has been well documented in countless text books, videos and teaching manuals. Generally however these types of teaching aids, albeit unconsciously, only tend to supply and offer directions to readers/viewers that are based on a particular identifiable player as perceived by that player or coach of that player. This approach to teaching golf often stereotypes a player having certain physical attributes hence its application is very much restricted to that player type. Clearly golf attracts players for various reasons and it is understandable that each player has a different physique and a different muscle strength profile, and a different mindset which results in many unique but different golf swings and putting actions for every player.

One option to address this shortfall has been for players and/or teaching manuals to make generalisations. However this may not specifically apply to the prospective player using the generalisations. An alternative option to help improve playing proficiency has been to seek tuition from a club professional. This however has the disadvantage of being of limited duration, costly and still requires practicing the various techniques taught after a lesson has finished. In many instances club/recreational golfers focus on achieving a consistent golf swing since the distance from tee to green is perceived as the major obstacle to obtaining a reasonable score. Having approached the putting green however it is often the case that the number of strokes taken to sink the ball into the cup equates to the number of strokes taken between tee and green despite being only a relatively short distance from the cup.

A proficient golfer who putts badly will inevitably accumulate a high score by taking more strokes to place the ball in the cup. On average each hole on a standard golf course caters for two strokes per green. This means that on an 18-hole golf course with a par of say 72, the number of putting strokes is likely to constitute on average 50% of a par score. A putting stroke generally requires a player to properly address the ball and contact the ball with a planar face portion of a putter head. If however movement occurs during the course of playing a putting stroke it is likely that the ball will exit the putter face in an uncontrolled direction. Movement can take place in a number of ways including player movement in which a player may sway laterally from a centrally located vertical axis or angular movement of the putter head and/or shaft during execution of a stroke. Similar considerations are relevant to a golf swing.

The United States Golf Association (USGA) and the Royal and Ancient Golf Club of St Andrews define the official rules of golf and have defined that a club is an implement designed to be used for striking the ball and generally comes in three forms: woods, irons and putters distinguished by shape and intended use. A putter is a club with a loft not exceeding ten degrees designed primarily for use on the putting green. Golf putters can be legally constructed with a bend in the bottom 5 inches from the putter head and the putter shaft can be connected to putter head at an angle from the vertical and an angle relative to the striking direction. The actual rules state:

(i) the projection of the straight part of the shaft on to the vertical plane through the toe and heel must diverge from the vertical by at least 10 degrees; and (ii) the projection of the straight part of the shaft on to the vertical plane along the intended line of play must not diverge from the vertical by more than 20 degrees forward or 10 degrees backward.

The result of this is a vast variation of designs of legally acceptable golf clubs. It is therefore necessary for golfing aids to be able to accommodate a range of legal configurations. To date this has not been achieved.

Not only are there a plurality of golf club designs but the golfer's use of the golf club is as varied. It is therefore necessary for golfing aids to be able to accommodate a range of stance and usage configurations. To date this has not been achieved.

It is therefore an object of the invention to provide a golfing aid, which overcomes or at least ameliorates the problems of the prior art.

It is also an object of the invention to provide a golfing aid, which provides objective assistance, which can be used to assist a player making a golf swing or putting action.

The aim of the product is to provide a putting aid to golfers during practice. The device needs to be able to be engaged and disengaged easily from the putter shaft. It also needs to be able to adjust to a variety of putter shaft diameters and tapers. The device will accommodate Putter Shafts from 12 mm down to 9.5 mm.

SUMMARY OF THE INVENTION

In accordance with the invention there is provided a golfing aid having a levelling sensor, a mounting means for adjusting the orientation of the levelling sensor and an indication output for providing an indication of the sensed level orientation In this way the golfing aid assists the player in maintaining a level approach of the golf club or putter over a certain distance prior to hitting the ball, while hitting the ball and over a certain distance in the follow through. By having an objective indicator of the orientation of your stroke each and every player can improve their resulting swing regardless of the way a player addresses the ball, the angle of the club, and each and every player can improve their resulting swing the style of a golfer's swing or physique.

The levelling sensor can include at least one spirit level. The levelling sensor can include two spirit levels oriented in the same plane and at right angles to each other.

Throughout this document a "spirit level" includes a level, which uses a bubble in a liquid in a capsule, and the level orientation is shown by the relative location of the bubble in the capsule. It also includes a liquid in a capsule and an indicator article, which floats in the liquid.

The mounting means in one form for adjusting the orientation of the levelling sensor can include a body portion for housing the levelling sensor, an attachment portion for attaching to a golf club or putter and an adjustable connector engaging the body portion for allowing adjustment of the orientation of the body portion relative to the golf club or putter in use when the mounting means is attached thereto.

The mounting means in another form can be integral with or permanently attachable to the golf club or putter. In this form the mounting means can include an adjustable connector engaging the putter body for allowing adjustment of the orientation of the levelling sensor body portion relative to the orientation of the golf club or putter when in use.

The indication output can be a visual output by means of the levelling sensor having visual indication of the level orientation. In the form of the use of at least one spirit level the capsule can be transparent with surface markings and the liquid coloured such that the orientation of the bubble can be readily viewed by the relative position of the bubble to the surface markings.

The indication output can be a sensed output by means of the levelling sensor having a detection means and sending a signal of the orientation. The signal can be received by a display means and instantly displayed.

The display could be a light colour option. For example a green light such as a green light emitting diode (led) is switched on upon receipt of signal from the levelling sensor such that the sensed orientation is level or within defined predetermined acceptable boundaries. The green led switches off and a red led switches on when the levelling sensors sense the level orientation being outside the predetermined acceptable boundaries.

The signal can also be recorded over time. The recorded time signal can be downloaded for viewing. However the display means can include a time period display to display the orientation over time. A ball contact sensor could be incorporated to sense a jolt indicative of a contact with the golf ball. The display could display the orientation over time and superimpose the time of the ball contact such that the display clearly differentiates the approach to contact the ball and the follow through of the golf swing or putting action.

The indication output can be a digital output by means of the levelling sensor having a detection means and sending a digital signal of the orientation In one form the levelling sensor includes two spirit levels mounted in the same plane and at right angles to each other in the mounting means. The mounting means can be a D-shaped body in which a first of the spirit levels extends along the linear side of the D-shaped body while the second spirit level extends at right angles from a mid portion of the first spirit level through the centre of the D-shaped body. The D-shaped body can include a first linear portion connected to two substantially symmetrical curved edge portions forming an apex. The frame can also include a second linear portion at right angles to the first linear portion between the apex and a central edge of the first linear portion there extends. The frame can further include a third linear portion, which extends from the second linear portion, at a distance from both the first linear portion and the apex, to connect with a part of the curved edge.

The attachment portion can include an encapsulating socket adapted to be received on a curved edge of the D-shaped body, and a closeable shaft bracket for clamping around a shaft portion of a golf club or putter. A shaft/arm can extend from the rear of the closeable clamp and has a ball integrally connected at a distal end such that the ball can be movably held within the encapsulating socket to provide a degree of movement in a single plane. The movability of the ball in the encapsulating socket provides an adjustable connector engaging the D-shaped body for allowing adjustment of the orientation of the D-shaped body relative to the golf club or putter in use when the mounting means is attached thereto.

In another form the attachment portion can allow for two elements of adjustability in two directions. The closable shaft bracket can include an opening or recess to receive a cylindrical shaft member in movable relation. The socket on a curved edge of the D-shaped body can engage a cylindrical end part of the shaft member extending from the closable shaft bracket to enable adjustable clamping around a golf club or putter in more than one dimension. The shaft member can extend from the rear of the closable clamp wherein the cylindrical end part can be integrally connected at a distal end to the socket by the arm, wherein the shaft member is movably held by opposing screws from the closable shaft bracket along an elongated central axis of the cylindrical shaft member. The movability of the cylindrical shaft member is rotational, relative to the closable shaft bracket around the shaft of putter or golf club to which it is attached a centrally located longitudinal axis and provides a further single directional adjustable connector engaging the D-shaped body for allowing adjustment of the orientation of the D-shaped body relative to the golf club or putter in use when the mounting means is attached thereto.

The invention also provides a method of improving a golf swing or putting action including the following steps:

- providing at least one levelling sensor;
- wherein at least one sensor can be aligned substantially parallel to a line of approach and impact of the golf club with the golf ball; or at least another sensor can be aligned substantially normal across the line of approach and impact.

The invention also provides a method of improving a golf swing or putting action including the following steps:

- providing at least two levelling sensors in a T-shaped arrangement on a body frame;
- adjusting the body frame relative to the use's set-up for a swing action, aligning at least one sensor substantially to follow a line or at least parallel to a line of approach and impact of the golf club with the golf ball and aligning and at least another sensor can be aligned substantially normal across the line of approach and impact; and
- providing an indication output from the at least two levelling sensors impact such that the user can receive an indication of the golf club being aligned to provide a vertical face of the golf club by following a horizontal plane.

The method of improving a golf swing or putting action can include the step of attaching the body frame to a golf club.

BRIEF DESCRIPTION OF THE DRAWINGS

In order that the invention is more readily understood an embodiment will be described by way of illustration only with reference to the drawings wherein.

DESCRIPTION OF THE PREFERRED EMBODIMENTS OF THE INVENTION

Figure 1:
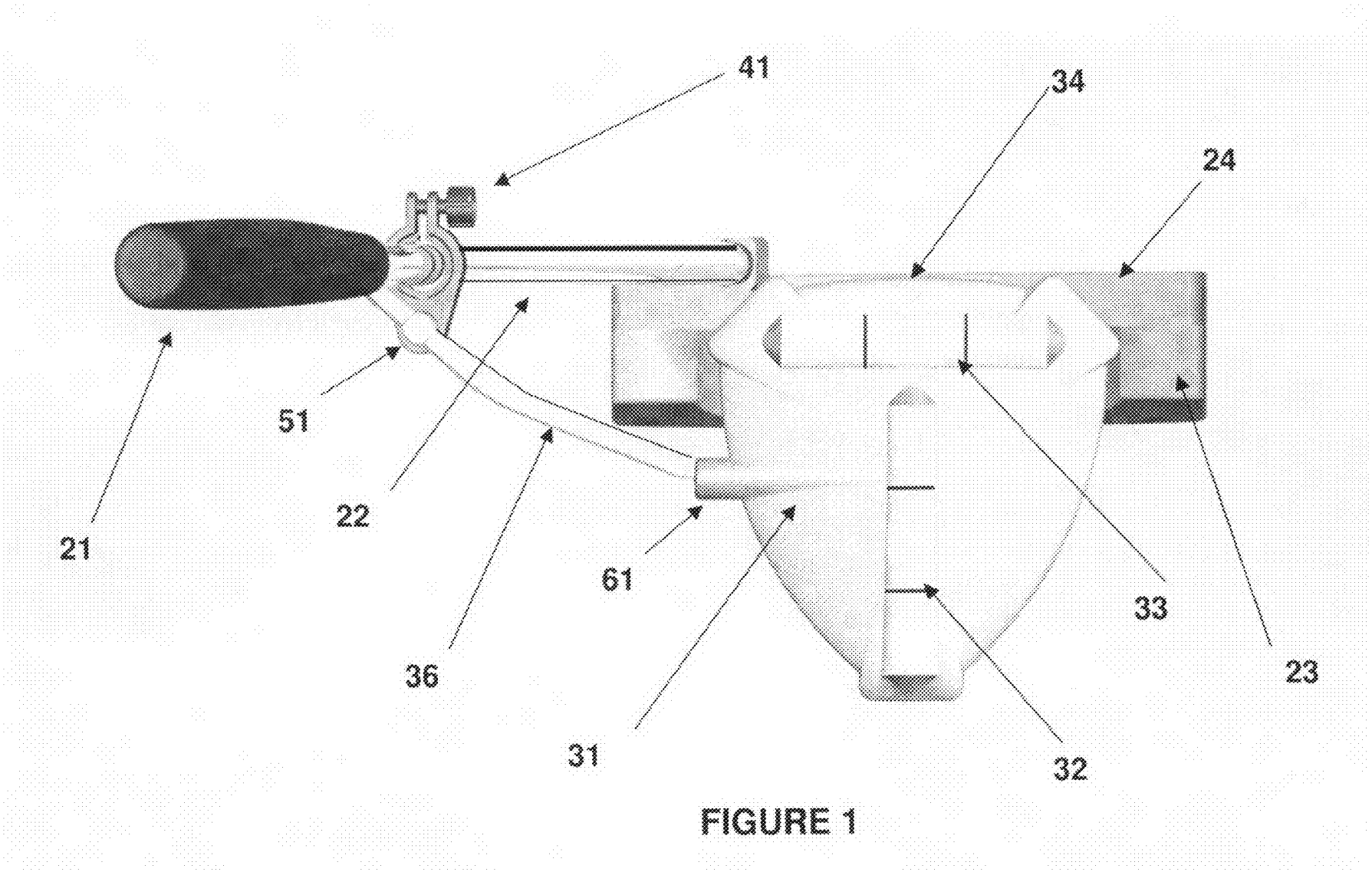
FIG. 1 is an overhead view of a golfing aid in use attached to a golf putter in accordance with a first embodiment of the invention.

Referring to the various embodiments shown in the drawings in which similar features are identified with similar numerical indicators and operate similarly, there is shown a golfing aid 11 having two levelling sensors 32, 33 mounted on a D shaped sensor body 31 and a mounting means having three adjustable connectors 41, 51, 61 for adjusting the orientation of the D shaped sensor body 31 and an indication output in the form of spirit level bubbles 32, 33 for providing an indication of the sensed level orientation.

Figure 8:
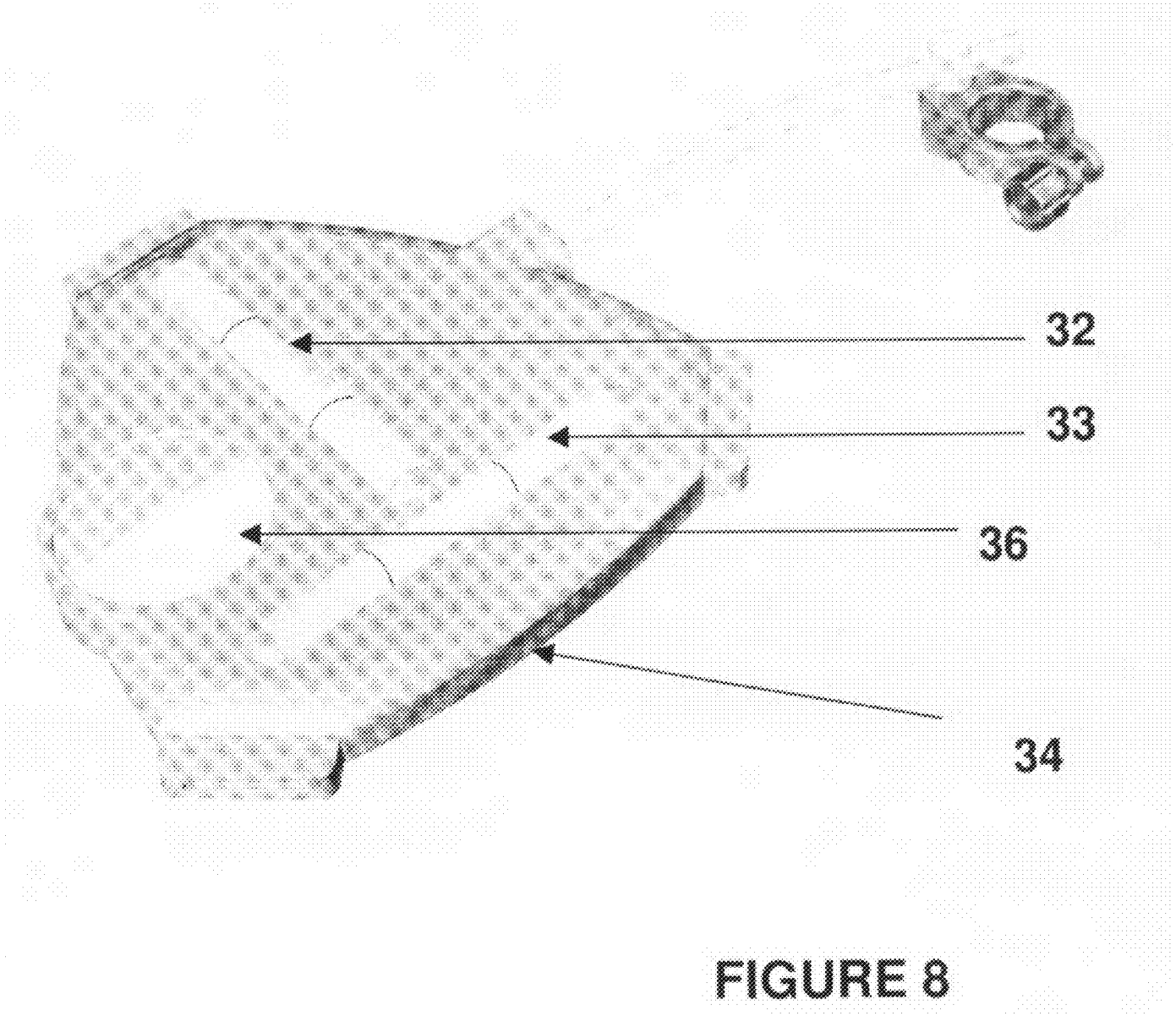
FIG. 8 is a perspective view of a golfing aid for attachment to a golf putter in accordance with a fourth embodiment of the invention including multiple spirit levels and face indicator.
Figure 9:
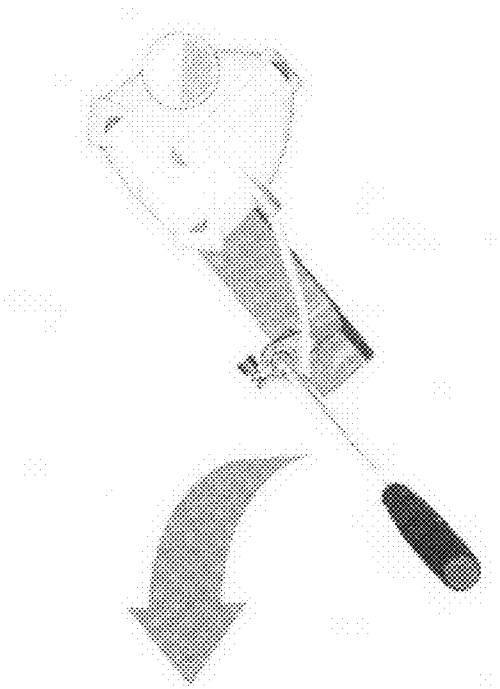
FIG. 9 is three overhead views of the golfing aid according to the fourth embodiment attached to a golf putter and in use indication three distinctly different results.
Figure 10:
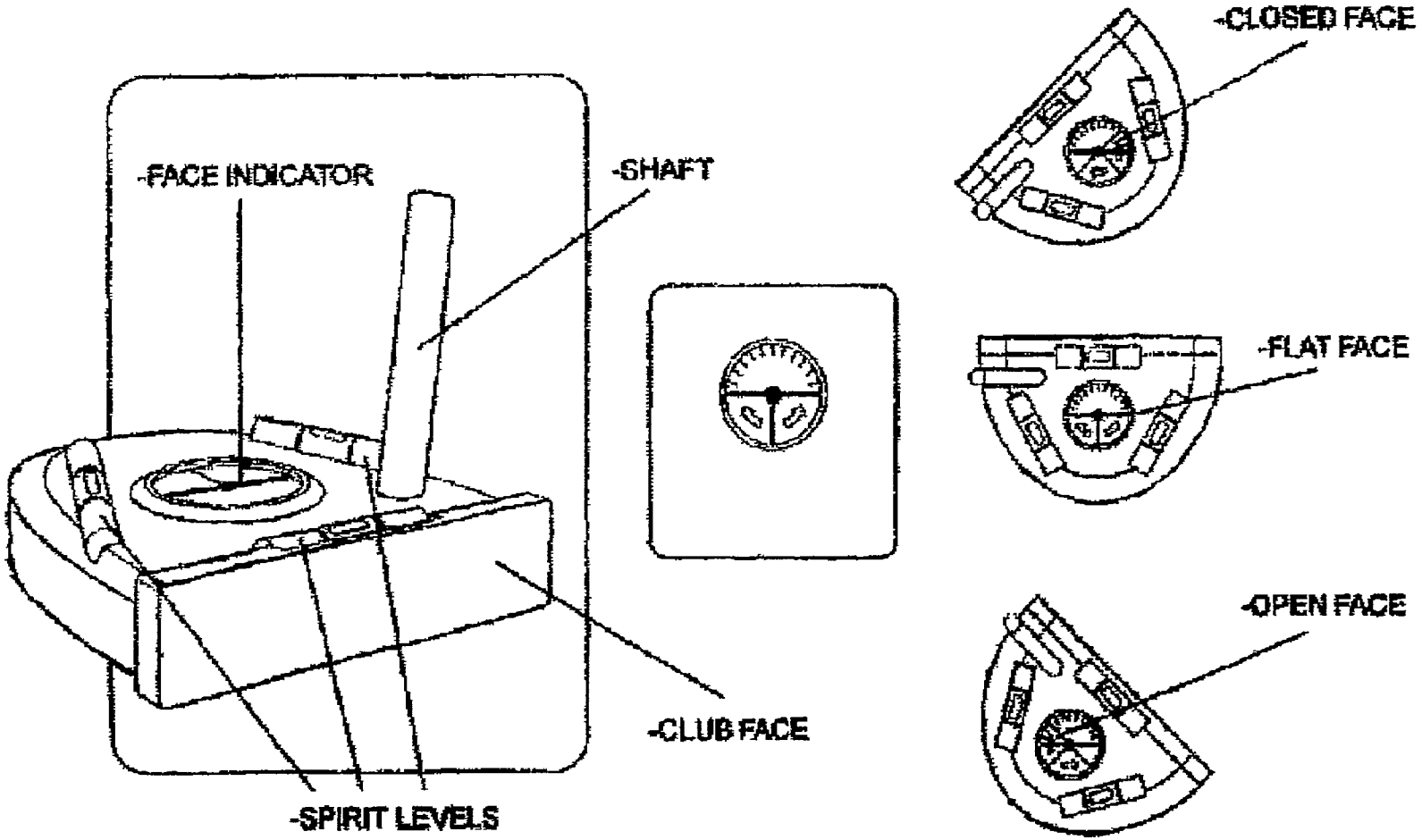
FIG. 10 is a perspective view of a golfing aid for attachment to a golf putter in accordance with a fifth embodiment of the invention including multiple spirit levels and face indicator and with three overhead views of the golfing aid according to the fourth embodiment if attached to a golf putter and in use showing indication of three distinctly different results.

The golfing aid 11 is attachable to the shaft 22 of a golf putter having putter head 23 at a lower end with a ball striking putter head face 24 and a handle 21 at an upper end for the user to hold the putter in use. The golfing aid 11 has at least one orientation sensor in the form of the spirit levels in FIGS. 1 an 2 or spirit levels 32, 33 and a rotation sensor 36 with an indication output providing an indication of the sensed orientation when the ball was struck as shown in FIGS. 8, 9 and 10.

The golfing aid 11 includes a body having a basically D-shape with a front golfing aid front face 34 that can overly the front putter head face 24 and having a rear connecting shape. The front golfing aid face 34 can include a slight curvature or other indicator to allow for identifying of the optimal middle contact point of the putter head face 24. The golfing aid 11 further includes attachment portions for attaching the golfing aid to the shaft of the golf putter and adjustable connectors 41, 51, 61 for providing location of the front golfing aid front face 34 to overly the front putter head face 24.

The D-shaped body 31 levelling sensors 32 and 33 are in the form of two single spirit levels. A first 32 of two single spirit levels is mounted on the D-shaped body 31 linearly along a line normal to the front golfing aid face 34 and including the point of the front golfing aid face 34 that is to align with the optimal middle contact point of the putter head face 24. Therefore this sensor shows a level approach of the putter in the direction of contact with a golf ball when attached to the golf putter and in use. A second 33 of the spirit levels extends substantially across the D-shaped body 31 parallel to the front golfing aid face 34. Therefore this sensor shows a level attitude of the golf putter head face 24 so that the toe and heel of the golf putter are at the same level and a linear flat approach of the putter head face occurs in the direction of contact with a golf ball when attached to the golf putter and in use.

As can be seen the golfing aid 11 includes a mounting means comprising a connecting arm 36 extending from attachment portion 41 that attaches to the putter shaft 22 to the D-shaped body 31 that overlies the putter head 23.

Figure 2:
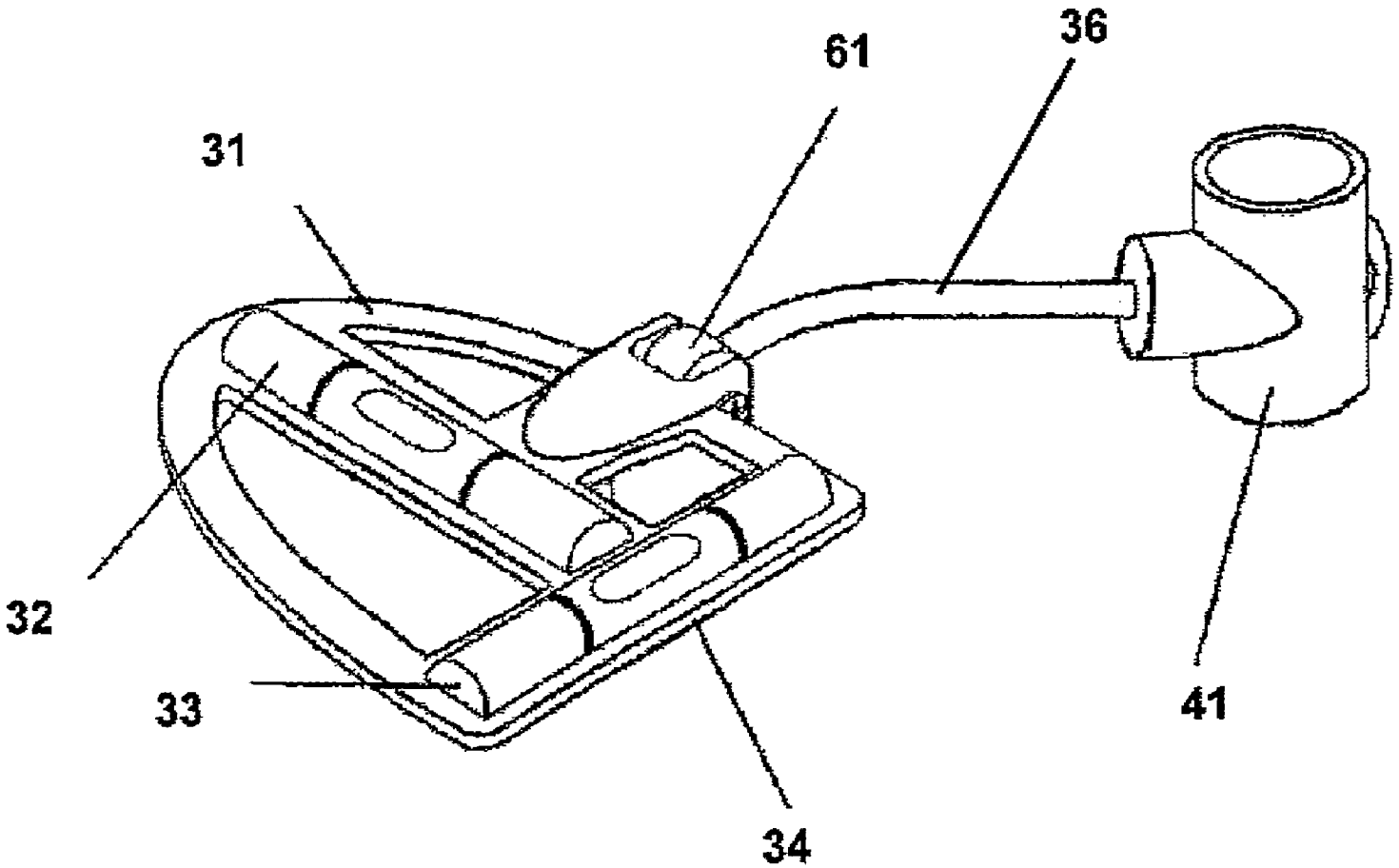
FIG. 2 is perspective view of a golfing aid for attaching to a golf putter in accordance with a second embodiment of the invention.

As shown in FIGS. 1 and 2 the attachment portion 41 includes a closable cut cylinder which can encapsulate a shaft 22 of a golf club or putter and be clamped shut. However in the novel form of FIG. 3 and particularly FIG. 6 there is further included a U-type shaft connector that extends around the putter shaft 22 and at the open ends includes a closing member with a cam housing sliding along inner tracks at an angle to the putter shaft and enclosing a shaft pressure pad to engage the putter shaft. Behind the shaft pressure pad is a cam lever and cam lever spring support that allows for exerting locking force of the pressure pad on the putter shaft. By the slidability of the closing member at an angle to the putter shafts different diameter putter shafts can be received and the cam operated locking mechanisms can ensure locking on the shaft. A tie strap attached to the slidable closing member with a cam housing and the body portion that can encapsulate the connecting arm 36 ensures that if released the slidable closing member with a cam housing is not misplaced.

Looking at the attachment means in more detail the attachment is achieved by having a cam housing, which engages with the shaft connector in two angled dove-tails. The shaft connector is fitted to the putter shaft and the cam housing is slid down the dove-tails until the pressure pad makes contact with the putter shaft. The cam lever is then depressed downwards. The cam lever Pivots on a small pin through the pressure pad and has a slightly longer pin, through slots in each arm, with a small roller at each end. These rollers are guided by a recessed track in each half of the cam housing. The cam lever is spring loaded against the pressure pad by a spring, which is mounted on two interconnected slidable spring guides: the cam lever spring support and the pressure pad spring support. The recessed tracks in the cam housing halves are shaped to move the pin and rollers 1 mm towards the pressure pad thus compressing the spring and exerting clamp pressure on the putter shaft. The cam lever, pin and rollers move slightly over-centre at the bottom of the track thus imparting a toggle action and retaining the cam lever in the locked position. To remove the device from the putter shaft lift the cam lever up to the top of its travel. This will release the clamp pressure on the putter shaft and allow the cam housing to be removed from the shaft connector. This frees the device from the putter shaft. The cam housing remains tethered to the device by a tie strap, which is clamped between the two cam housing halves with the other end being attached to a lug on the side of the swivel socket.

An important element of the invention is the provision of a system of interactive adjustable connectors linked together to provide such variability that allows connection to any one of left and right handed clubs with different shaft diameters, different angle of putter shaft to putter head and different length shafts and different length putter heads to allow for substantially aligned overlying of the D shaped sensor body 31 over the putter head 23 while substantially aligning the golfing aid front face 34 correctly with the putter head front face 24.

The D shaped sensor body 31 and a mounting means has three adjustable connectors 41, 51, 61 for adjusting the orientation of the D shaped sensor body 31. The mounting means includes three adjustable connectors, a first 41 as an attachment part to the golf club shaft 22, a second 51 between the attachment part 41 and one end of a connecting arm 36 and a third 61 between the other end of the connecting arm 36 and the D shaped body housing 31 having the orientation sensors.

Referring to FIG. 2 there is a first adjustable connector 41 in the form of a shaft-encapsulating bracket that can be located at the required position along the putter shaft 22. This allows a first degree of orientation of the D-shaped body 31 with respect to the shaft of a golf club. The angled connector arm 36 extends from the first adjustable connector 41 to a third adjustable connector 61 and includes a ball 39 integrally connected at a distal end and forming a movable joint within an encapsulating socket in the side of the D-shaped body 31. The movability of the ball in the encapsulating socket provides a second degree of movement pivoting in a plane transverse to the rotational movement of the cylindrical shaft to effect displacement of the bubble display means along the linear edge of the D-shaped body. The attachment portion(s) therefore provide for two elements of adjustability in two planes.

Figure 3:
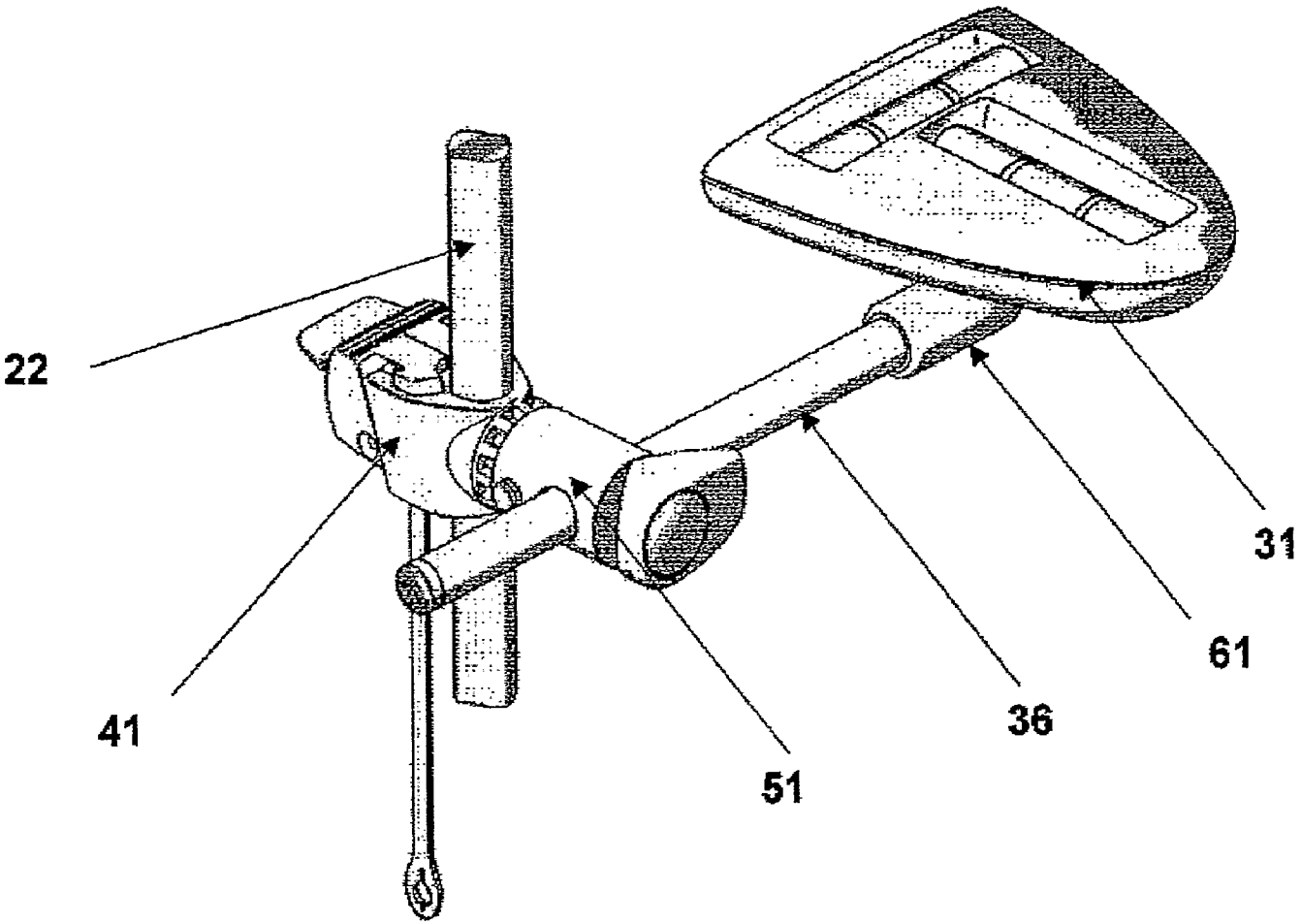
FIG. 3 is perspective view of a golfing aid for attaching to a golf putter in accordance with a third embodiment of the invention.

However the novel embodiment of FIG. 3 includes more degrees of movement. This is created by the first adjustable connector having on one side including a cam locking means for attaching at a predefined position on the putter shaft and having at an opposite side a partial ball formation for engaging within a socket of the second adjustable connector 51. The second adjustable connector further including a through bore for receiving a connecting arm at a required angle and providing adjustment of length of arm between second adjustable connector and third adjustable connector. The third adjustable connector including a swivel means allowing for rotational swivel of D-shaped body 180 degrees. The third adjustable connector to the D-shaped body further includes a ball and socket connection.

Figure 5:
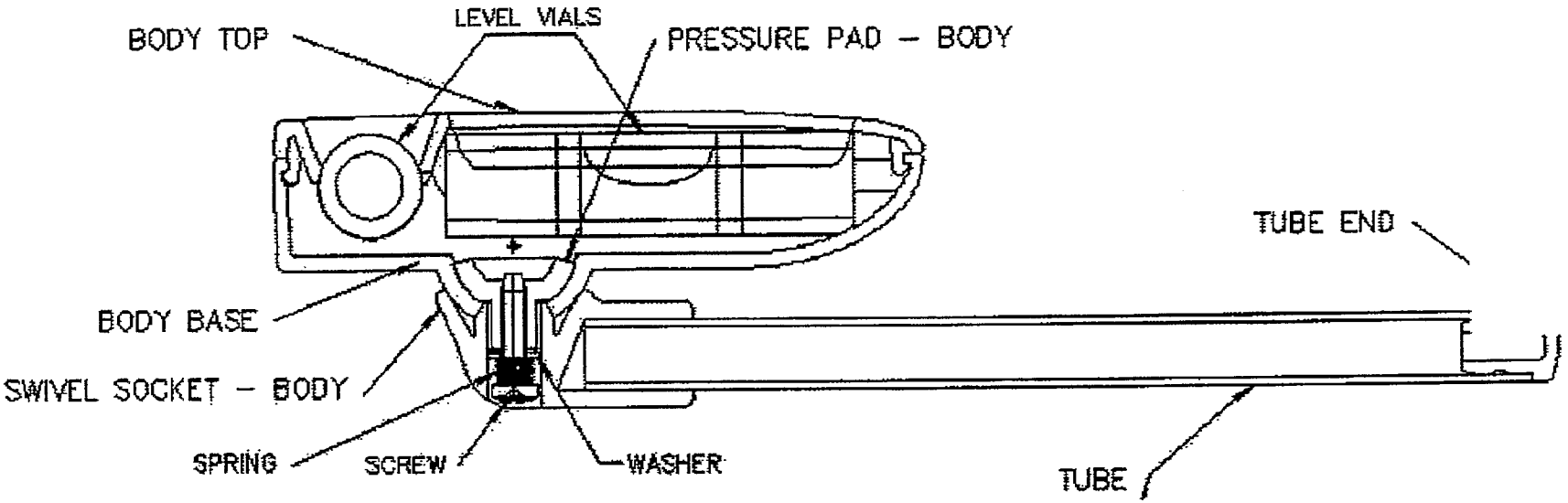
FIGS. 5 and 6 are side diagrammatic parts view of the two connecting sections of the golfing aid of FIGS. 3 and 4 for attaching to a golf putter in accordance with the third embodiment of the invention.

In more detail as shown in FIG. 5, the interactive arrangement of the D-shaped body to the connecting arm in the form of a tube has a tube end fitted at one end and is contained by a fitting which swivels on the shaft connector. The tube is fitted to the swivel socket (body). The head is required to swivel and rotate 360 degrees on the tube. This is achieved by having a spherical pressure pad (body) clamping the body base to the swivel socket (body) using a screw, spring and washer. The swivel resistance can be adjusted for feel with this screw. The level vials are fitted to recesses in the body base. A glossy white or reflective membrane is formed and inserted in the recesses under the level vials to enhance their readability. The body top is then clipped in place thus retaining the level vials and completing the assembly.

Figure 6:
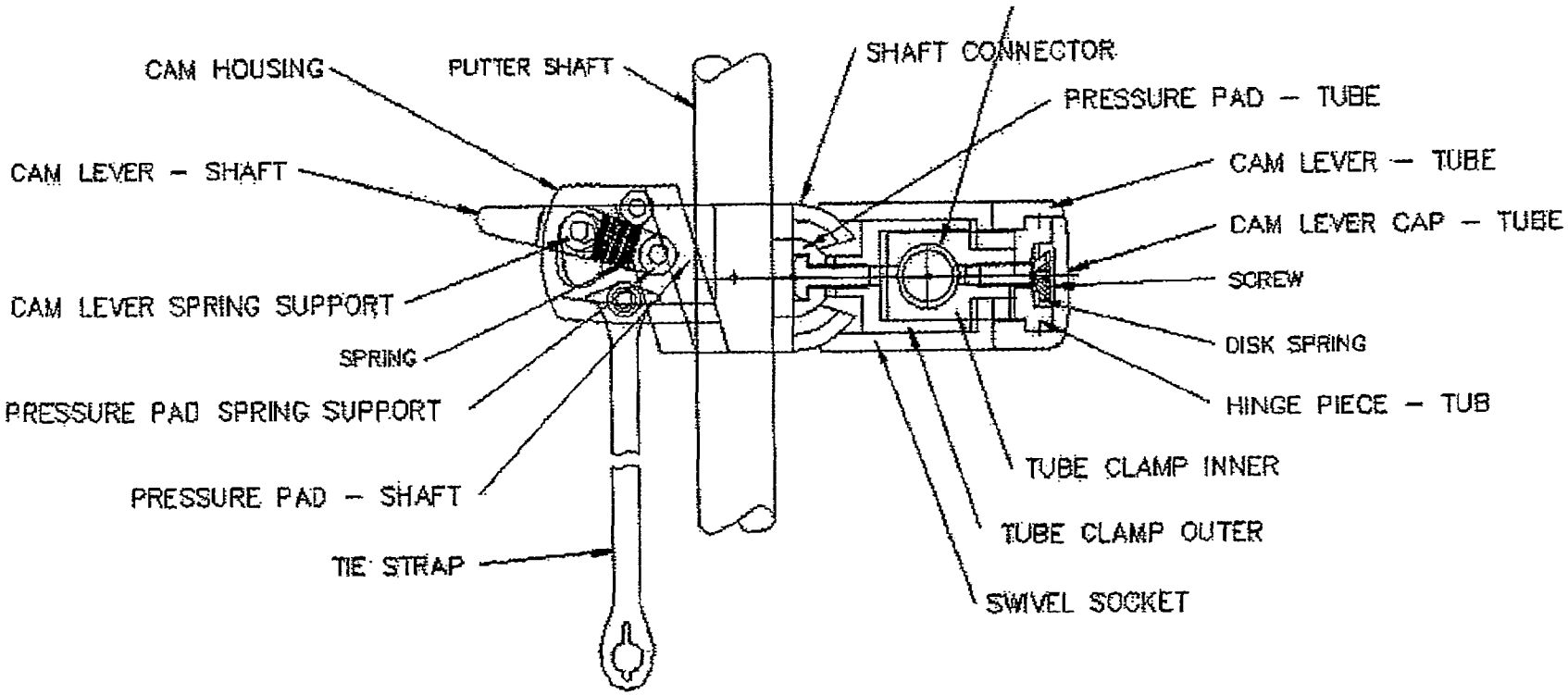

Connection of the connecting arm 36 to the second adjustable connector 51 as shown in FIG. 6 is achieved by having a spherical pressure pad screwed to the tube clamp outer with the tube clamp inner inside it. The swivel socket is fitted over both of these. The cam lever is then fitted over an extension of the tube clamp inner and is retained by screwing the hinge piece to the tube clamp inner with a disk spring under the countersink screw head. This screw is left slightly loose, as it is more convenient to adjust the pressure of the cam action by adjusting the position of the screw holding the pressure pad to the clamp outer. This is done with the tube in place but with the cam housing removed. When adjusted correctly the cam lever locks all the tube clamp functions in one action. When unlocked, the tube can be slid in and out along its length and rotated through 360 degrees, plus the swivel action is operable and is also able to be rotated through 360 degrees for left or right hand operation.

The adjustments allowable include:

a) location up and down the putter shaft by altering of first attachment means 41 acting as first adjustable connector;

b) location closer or further away from putter shaft by alteration of the extension of the connecting arm 36 into the second adjustable connector 51 to allow for alignment of central indicator of the golfing aid above the optimal hitting position of the putter head face;

c) rotation of the D shaped sensor body 31 due to rotation of the connecting arm 36 in the second attachment means 51 to provide general level alignment of the D shaped sensor body 31 relative to the putter when in use;

d) relative angle of the connecting arm to the putter shaft 22 by rotation of second adjustable connector 51 relative to first adjustable connector 41 to assist in aligning the front golfing aid surface 34 with the putter head face 24;

e) rotation of the D shaped sensor body 31 due to rotation of the D shaped sensor body 31 on the connecting arm 36 to allow for connection to right handed or left handed club shaft and correct facing of the D shaped sensor body 31; and f) angular variation of the D shaped sensor body 31 relative to the connecting arm 36 to allow for final fine tuning of levelling of D shaped sensor body 31 when attached to the putter shaft.

Figure 7:
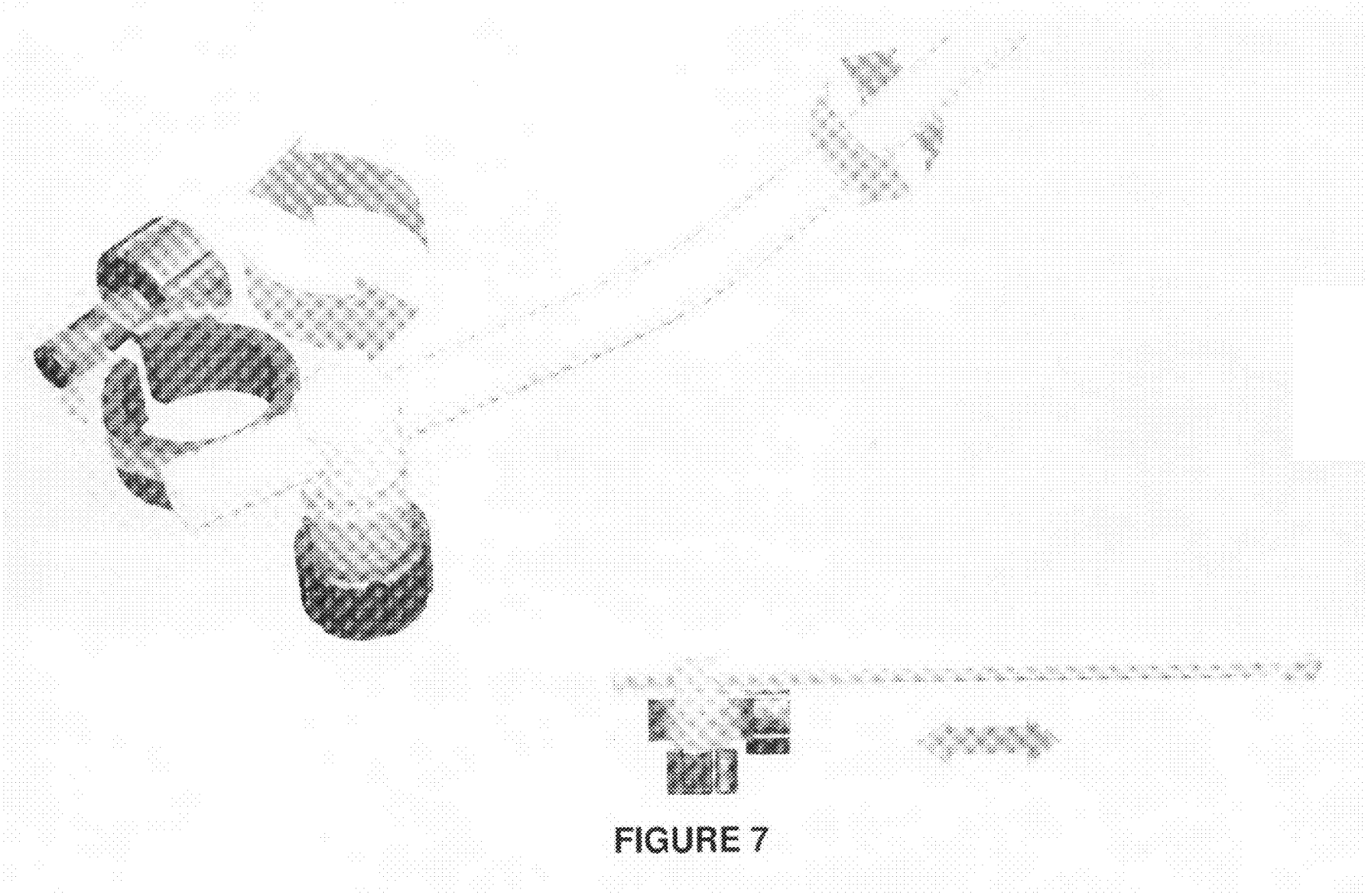
FIG. 7 is a perspective and side perspective view of the first embodiment of the golfing aid of FIG. 1 showing multiple adjustments.

A limited number of these adjustments are shown in the embodiment shown in FIG. 7. However the embodiment of FIG. 3 is able to fulfil all of these adjustments.

Figure 4:
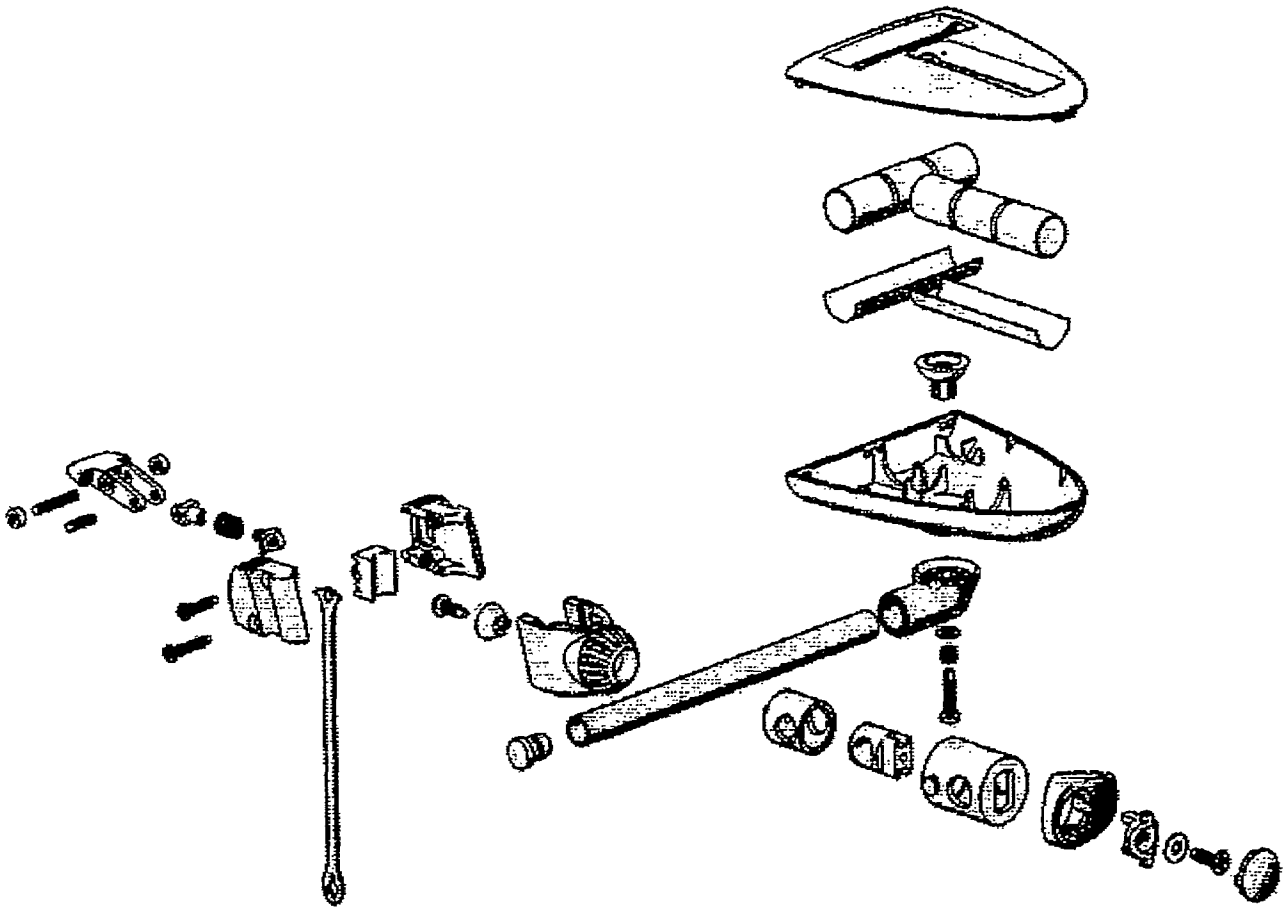
FIG. 4 is an exploded view of the golfing aid of FIG. 3 for attaching to a golf putter in accordance with the third embodiment of the invention.

Referring to FIGS. 2, 3 and 4 there is shown a golfing aid having a levelling sensor, a mounting means for adjusting the orientation of the levelling sensor and an indication output for providing an indication of the sensed level orientation.

In use the player attaches the D-shaped body to a golf club by attaching the shaft bracket to a shaft of a golf club. The player then adjusts the D-shaped body relative to the users swing action aligning at least one sensor substantially to follow a line or at least parallel to a line of approach and impact of the golf club with the golf ball. The second sensor can be aligned substantially normal across the line of approach and impact. The indication output is a visual output by means of the levelling sensor having visual indication of the level orientation such that the spirit level capsules have a transparent window with surface markings and the liquid coloured such that the orientation of the bubble can be readily viewed by the relative position of the bubble to the surface markings and provides an indication output from the at least two levelling sensors impact such that the user can receive an indication of the golf club being aligned to provide a vertical face of the golf club by following a horizontal plane.

In this way the golfing aid assists the player in maintaining a level approach of the golf club or putter over a certain distance prior to hitting the ball, while hitting the ball and over a certain distance in the follow through. By having an objective indicator of the orientation of your stroke regardless of the way you stand, the angle of your club, the style of your swing or your physique, each and every player can improve their resulting swing.

Referring to FIGS. 8, 9, and 10 there is shown a further embodiment of the golfing aid including multiple spirit levels 32, 33 and face indicator 36. The spirit levels in FIG. 8 are similar to FIG. 3 with the face indicator providing an indication of the angle of the golf aid face 34. As this corresponds in use to a position over the front putter head face 24 it provides an indication of the angle of contact of the front putter head face 24 on the golf ball. For example as shown in FIG. 9 there can be a closed face, straight stroke or open face as understood in the striking of a golf ball.

In FIG. 10 there are three spirit levels arranged relative to each other to be coplanar in a plane normal to the front striking surface of the putter head. However the plurality of spirit levels are arranged in a relative equilateral triangular configuration with a first spirit level parallel with and just behind the front striking surface of the putter head. The other two are mounted symmetrically therebehind. In this way the three spirit levels give clear indication of the appropriate plane of movement of the putter head.

The face indicator can comprise a floating disc on central pin in the same manner as a compass. The arrangement can be such that the floating disc can be adjusted relative to a magnetic system therebelow and thereby change of angle of the top-floating disc will be the same as the change of magnetic direction from initial direction. For example with reference to FIG. 9 if the floating disc positioned North then the magnetic North will retain the floating disc in position even if open club face and the relative position of the retained position of the floating disc relative to the final position of the club head provides indication of the shot taken.

However in another form instead of magnetic orientation the floating disc can include diametrically located weights or a central leading weight such that if the club face flows in the straight line the inertia of the diametrically opposed weights would cancel each other out and the indicator will remain showing a flat face. However if the flow of the putter was not square but at angle then the inertia effect on one diametrically opposed weight would be different to the other and the floating disc would rotate partially to indicate the difference and show the ball was not hit with the putter face square but with closed or open face.

Other methods could be used on the face indicator such as diametrically opposed vanes or other means such as electronic means.

Although particular characteristics of the golfing aid have been discussed, these could be varied to suit the requirements of various individuals, and various shaped clubs both left or right handed which are all in accordance with the present invention, and as determined by the intended end use for the overall device, as will occur to those skilled in the art upon review of the present disclosure.

It will be understood that each of the elements described above, or two or more together can also find a useful application in other types of methods differing from the type described above.

The invention has been described using exemplary preferred embodiment. However, it is to be understood that the scope of the invention is not limited to the disclosed embodiment but to the following claims. It is intended to cover various modifications and similar arrangements readily understood without any inventiveness by a person skilled in the art. The scope of the invention, therefore, should be accorded the broadest interpretation so as to encompass all such modification and similar arrangements. Various features of the above noted aspects of the invention can also be interchanged which will be readily apparent to those skilled in the art on review of the above.

The invention claimed is:

1. A golfing aid for attachment to a golf club or putter and having mounting means including: two or more adjustable connectors providing at least two degrees of freedom to allow orientation of a leveling sensor comprising at least two spirit levels mounted in the same plane and attachable substantially normal to the plane of the contact surface of the golf club or putter; and, wherein the mounting means includes an attachment portion for attaching the golfing aid to the shaft of the golf club or putter, and a connecting arm extending to and substantially for positioning the levelling sensor over the golf club head of the golf club or putter.

2. A golfing aid according to claim 1 further including an orientation sensor having a rotation sensor capable of showing the angle of contact of the club face of the golf club or putter normal to the orientation of the plane of the at least two spirit levels.

3. A golfing aid according to claim 1 wherein the mounting means includes: a body portion for housing the levelling sensor; an attachment portion for attaching the golfing aid to the shaft of the golf club or putter, and a connecting arm extending to and for positioning the levelling sensor over the golf club head of the golf club or putter; an arm adjustable connector engaging the body portion for allowing adjustment of the orientation of the body portion relative to the golf club or putter in use when the mounting means is attached thereto and allowing adjustment of the orientation of the connecting arm while attached to the golf club or putter; and a sensor adjustable connector allowing adjustment of the orientation sensor relative to the connecting arm wherein the mounting means is integral with or permanently attachable to the golf club or putter and includes an adjustable connector for engaging the golf club or putter for allowing adjustment of the orientation of the levelling sensor body portion relative to the orientation of the golf club or putter when in use.

4. A golfing aid according to claim 3 wherein the mounting means allows for rotational adjustment of the orientation of the connecting arm.

5. A golfing aid for attachment to a golf club or putter and having: at least one orientation sensor with an indication output providing an indication of the sensed orientation, and a mounting means for mounting the golfing aid to a golf club or putter and allowing adjustment of the orientation of the sensor relative to the club face of the golf club or putter when in the user's stance, such that the indicated orientation output is indicative of the user's orientation or address of the golf club or putter to the golf ball in use, whereby the mounting means includes three adjustable connectors, a first as an attachment part attachable to a golf club or putter shaft, a second between the attachment part and one end of a connecting arm and a third between the other end of the connecting arm and a shaped body housing the at least one orientation sensor, wherein the adjustments allowable include:

a) location up and down the golf club or putter shaft by altering of first attachment means acting as first adjustable connector;

b) location closer or further away from the golf club or putter shaft by alteration of the extension of the connecting arm into the second adjustable connector to allow for alignment of the central indicator of the golfing aid above the optimal hitting position of the golf club or putter head face;

c) rotation of the shaped sensor body due to rotation of the connecting arm in the second attachment means to provide general level alignment of the shaped sensor body relative to the golf club or putter when in use;

d) relative angle of the connecting arm to the golf club or putter shaft by rotation of the second adjustable connector relative to the first adjustable connector to assist in aligning the front golfing aid surface with the golf club or putter head face;

e) rotation of the shaped sensor body due to rotation of the shaped sensor body on the connecting arm to allow for connection to a right handed or a left handed golf club or putter shaft and correct facing of the shaped sensor body; and f) angular variation of the shaped sensor body relative to the connecting arm to allow for final fine tuning of levelling of shaped sensor body when attached to the golf club or putter shaft.

6. A golfing aid according to claim 5 wherein the indication output is a visual output by means of the orientation sensor having visual indication of the orientation.

7. A golfing aid according to claim 6 wherein the indication output is a sensed output by means of the orientation sensor having a detection means and sending a signal of the orientation.

8. A golfing aid according to claim 7 wherein the signal is received by a display means and instantly displayed.

9. A golfing aid according to claim 8 wherein the display is a light display.

10. A golfing aid for attachment to a golf club or putter and having:

(a) at least one orientation sensor with an indication output providing an indication of the sensed orientation, and (b) a mounting means for mounting the golfing aid to a golf club or putter and allowing adjustment of the orientation of the sensor relative to the club face of the golf club or putter when in the user's stance, such that the indicated orientation output is indicative of the user's orientation or address of the golf club or putter to the golf ball in use;

(i) wherein the orientation sensor is a levelling sensor which includes two spirit levels mounted in the same plane and at right angles to each other in the mounting means, (ii) the mounting means is a D-shaped body in which a first of the spirit levels extends along the linear side of the D-shaped body while the second spirit level extends at right angles from a mid portion of the first spirit level through the center of the D-shaped body;

(iii) wherein the attachment portion includes an encapsulating socket adapted to be received on a curved edge of the D-shaped body, and a closable shaft bracket for clamping around a shaft portion of a golf club or putter, a shaft/arm extends from the rear of the closable clamp and has a ball integrally connected at a distal end such that the ball is movably held within the encapsulating socket to provide a degree of movement in a single plane and wherein the movability of the ball in the encapsulating socket provides an adjustable connector engaging the D-shaped body for allowing adjustment of the orientation of the D-shaped body relative to the golf club or putter in use when the mounting means is attached thereto.

11. A golfing aid according to claim 10 wherein the attachment portion allows for two elements of adjustability in two directions, with the closable shaft bracket including an opening or recess to receive a cylindrical shaft member in movable relation, the socket on a curved edge of the D-shaped body engaging a cylindrical end part of the shaft member extending from a closable shaft bracket to enable adjustable clamping around a golf club or putter in more than one dimension, the shaft member extends from the rear of the closable clamp wherein the cylindrical end part can be integrally connected at a distal end to the socket by the arm, wherein the shaft member is movably held by opposing screws from the closable shaft bracket along an elongated central axis of the cylindrical shaft member and wherein the movability of the cylindrical shaft member is rotational, relative to the closable shaft bracket around the shaft of a putter or a golf club to which it is attached a centrally located longitudinal axis and provides a further single directional adjustable connector engaging the D-shaped body for allowing adjustment of the orientation of the D-shaped body relative to the golf club or putter in use when the mounting means is attached thereto.

12. A golfing aid according to claim 10 including three adjustable connectors, a first as an attachment part to a golf club shaft, a second between the attachment part and one end of a connecting arm and a third between the other end of the connecting arm and a shaped body housing the at least one orientation sensor, a) wherein the first adjustable connector on one side includes a cam locking means for attachment at a predefined position on the golf club or putter shaft and having at an opposite side a partial ball formation for engaging within a socket of the second adjustable connector;

b) the second adjustable connector further including a through bore for receiving a connecting arm at a required angle and providing adjustment of the length of the arm between the second adjustable connector and the third adjustable connector;

c) the third adjustable connector including a swivel means allowing for rotational swivel of D-shaped body 180 degrees and the third adjustable connector to the D-shaped body further includes a ball and socket connection.

* * * * *